US008680969B2

(12) United States Patent
Ackmann et al.

(10) Patent No.: US 8,680,969 B2
(45) Date of Patent: Mar. 25, 2014

(54) METHOD OF CONFIRMING THAT A CONTROL DEVICE COMPLIES WITH A PREDEFINED PROTOCOL STANDARD

(75) Inventors: Evan R. Ackmann, Hoboken, NJ (US); Frank H. Benetz, Slatedale, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 976 days.

(21) Appl. No.: 12/642,926

(22) Filed: Dec. 21, 2009

(65) Prior Publication Data

US 2010/0238047 A1 Sep. 23, 2010

Related U.S. Application Data

(60) Provisional application No. 61/162,182, filed on Mar. 20, 2009.

(51) Int. Cl.
*G08B 5/22* (2006.01)

(52) U.S. Cl.
USPC ..... 340/6.1; 340/5.1

(58) Field of Classification Search
USPC ..... 340/825.36; 714/799, 699; 713/320, 713/300; 709/233, 16, 32; 370/468
See application file for complete search history.

(56) References Cited

U.S. PATENT DOCUMENTS

| | | | | |
|---|---|---|---|---|
| 5,272,657 | A * | 12/1993 | Basehore et al. | 708/422 |
| 6,008,593 | A * | 12/1999 | Ribarich | 315/307 |
| 6,225,759 | B1 * | 5/2001 | Bogdan et al. | 315/291 |
| 6,507,158 | B1 * | 1/2003 | Wang | 315/294 |
| 7,319,722 | B2 * | 1/2008 | Cassagnes | 375/282 |
| 7,369,060 | B2 | 5/2008 | Veskovic et al. | |
| 7,391,297 | B2 | 6/2008 | Cash et al. | |
| 7,417,556 | B2 * | 8/2008 | Ling | 340/12.52 |
| 7,446,671 | B2 * | 11/2008 | Giannopoulos et al. | 340/12.24 |
| 7,564,936 | B2 * | 7/2009 | Fonteneau et al. | 375/361 |
| 7,574,619 | B2 * | 8/2009 | Senda | 713/322 |

(Continued)

FOREIGN PATENT DOCUMENTS

EP 1484854 A2 12/2004

OTHER PUBLICATIONS

European Patent Office, International Search Report and Written Opinion for International Patent Application No. PCT/US2010/026806, Jun. 24, 2010, 13 pages.

(Continued)

*Primary Examiner* — Jennifer Mehmood
*Assistant Examiner* — Rufus Point
(74) *Attorney, Agent, or Firm* — Ostrolenk Faber LLP

(57) ABSTRACT

A control device, such as a digital ballast controller, is adapted to be coupled to an electronic ballast, such as a DALI ballast, via a communication link, and is operable to determine whether the ballast is operating within the specifications of a predefined protocol standard, e.g., the DALI standard. For example, the control device may measure the bit times of a digital message received from the ballast and to determine if the bit times fall within the limits set by the standard. The control device may also determine the minimum delay time required between two digital messages received by the ballast and determine if the minimum delay time falls within the limit set by the standard. The control device may adapt its normal operation (e.g., how digital messages are received and transmitted) or may provide feedback (e.g., by flashing a lamp) in response to determining that the ballast is operating outside of the specifications of the standard.

56 Claims, 5 Drawing Sheets

(56) References Cited

U.S. PATENT DOCUMENTS

| | | | | |
|---|---|---|---|---|
| 7,619,539 | B2 | 11/2009 | Veskovic et al. | |
| 7,688,004 | B2 * | 3/2010 | Huber | 315/307 |
| 7,847,706 | B1 * | 12/2010 | Ross et al. | 340/12.52 |
| 8,125,315 | B2 * | 2/2012 | Veskovic et al. | 340/6.1 |
| 8,143,811 | B2 * | 3/2012 | Shloush et al. | 315/297 |
| 8,421,588 | B1 * | 4/2013 | Ross et al. | 340/5.1 |
| 2002/0099451 | A1 * | 7/2002 | Wang | 700/4 |
| 2002/0126020 | A1 * | 9/2002 | Wang et al. | 340/825.52 |
| 2003/0020595 | A1 * | 1/2003 | Wacyk | 340/3.5 |
| 2003/0036807 | A1 * | 2/2003 | Fosler | 700/3 |
| 2003/0040891 | A1 * | 2/2003 | Cassagnes | 702/189 |
| 2003/0222603 | A1 * | 12/2003 | Mogilner et al. | 315/294 |
| 2004/0124786 | A1 * | 7/2004 | Morrissey, Jr. et al. | 315/291 |
| 2004/0217718 | A1 * | 11/2004 | Kumar et al. | 315/291 |
| 2004/0232852 | A1 * | 11/2004 | Huber | 315/224 |
| 2004/0245943 | A1 * | 12/2004 | Huber | 315/291 |
| 2005/0117671 | A1 * | 6/2005 | Aubree et al. | 375/333 |
| 2005/0175134 | A1 * | 8/2005 | Fonteneau et al. | 375/369 |
| 2005/0179404 | A1 * | 8/2005 | Veskovic et al. | 315/291 |
| 2006/0125426 | A1 * | 6/2006 | Veskovic et al. | 315/312 |
| 2006/0202851 | A1 * | 9/2006 | Cash et al. | 340/825.69 |
| 2006/0208661 | A1 * | 9/2006 | Mogilner et al. | 315/209 R |
| 2006/0212730 | A1 * | 9/2006 | Senda | 713/300 |
| 2006/0244624 | A1 * | 11/2006 | Wang et al. | 340/815.67 |
| 2007/0018783 | A1 * | 1/2007 | Erhardt | 340/3.5 |
| 2007/0091860 | A1 * | 4/2007 | Lery et al. | 370/338 |
| 2007/0113162 | A1 * | 5/2007 | Lery | 714/800 |
| 2007/0120653 | A1 * | 5/2007 | Paton | 340/301 |
| 2007/0291483 | A1 * | 12/2007 | Lys | 362/227 |
| 2008/0007394 | A1 * | 1/2008 | Roberts | 340/469 |
| 2008/0088180 | A1 * | 4/2008 | Cash et al. | 307/31 |
| 2008/0092075 | A1 * | 4/2008 | Jacob et al. | 715/771 |
| 2008/0136334 | A1 * | 6/2008 | Robinson et al. | 315/151 |
| 2008/0180270 | A1 * | 7/2008 | Veskovic et al. | 340/825.22 |
| 2008/0191837 | A1 | 8/2008 | Stocker | |
| 2008/0246415 | A1 * | 10/2008 | Chitta et al. | 315/293 |
| 2008/0258551 | A1 | 10/2008 | Chitta et al. | |
| 2008/0276154 | A1 * | 11/2008 | Hick et al. | 714/799 |
| 2008/0297070 | A1 * | 12/2008 | Kuenzler et al. | 315/308 |
| 2008/0310850 | A1 * | 12/2008 | Pederson et al. | 398/135 |
| 2009/0034420 | A1 * | 2/2009 | Boeckle et al. | 370/241 |
| 2009/0226176 | A1 * | 9/2009 | Franklin | 398/115 |
| 2009/0273433 | A1 * | 11/2009 | Rigatti et al. | 340/3.5 |
| 2010/0118887 | A1 * | 5/2010 | Matsumoto et al. | 370/465 |
| 2012/0230696 | A1 * | 9/2012 | Pederson et al. | 398/115 |

OTHER PUBLICATIONS

European Office Action dated Sep. 20, 2013 in corresponding European Patent Application No. 10 716 653.0-1807.

NXP: "AN10760 USB-DALI master using LPC2141", Nov. 1, 2008.

The Transmission Control Protocol, Apr. 24, 2000 retrieved from the Internet: URL:http://condor.depaul.edu/jkristof/technotes/tcp.html.

* cited by examiner

METHOD OF CONFIRMING THAT A CONTROL DEVICE COMPLIES WITH A PREDEFINED PROTOCOL STANDARD

CROSS-REFERENCE TO RELATED APPLICATIONS

This application claims priority from commonly-assigned U.S. Provisional Application Ser. No. 61/162,182, filed Mar. 20, 2009, entitled METHOD OF CONFIRMING THAT A DIGITAL ELECTRONIC BALLAST COMPLIES WITH THE DALI STANDARD, the entire disclosure of which is hereby incorporated by reference.

BACKGROUND OF THE INVENTION

1. Field of the Invention

The present invention relates to control devices operable to be coupled to a communication link, specifically, a method of confirming that a control device, such as a digital electronic ballast, complies with a predefined protocol standard, such as the Digital Addressable Lighting Interface (DALI) standard.

2. Description of the Related Art

Typical load control systems are operable to control the amount of power delivered to an electrical load, such as a lighting load or a motor load, from an alternating-current (AC) power source. Lighting control systems for fluorescent lamps typically comprise a controller and a plurality of electronic dimming ballasts that are operable to communicate via a digital communication link. The controller may communicate with the ballasts using, for example, the industry-standard Digital Addressable Lighting Interface (DALI) communication protocol. The DALI protocol allows each ballast (i.e., each DALI ballast) in the lighting control system to be assigned a unique digital address, to be programmed with configuration information (e.g., preset lighting intensities), and to control a fluorescent lamp in response to commands transmitted across the communication link.

A typical DALI lighting control system includes a link power supply that generates a direct-current (DC) link voltage $V_{LINK}$ (e.g., approximately 18 $V_{DC}$), which provides power for the DALI communication link. The DALI communication link comprises two conductors (i.e., two wires) and is coupled to each of the ballasts, such that each ballast receives the DC link voltage $V_{LINK}$ of the link power supply. The ballasts are also coupled to the AC power source to receive line voltage (e.g., 120, 240, 277, or 347 $V_{AC}$) for powering the fluorescent lamps.

According to the DALI protocol, the DALI ballasts encode the digital messages that are transmitted over the communication link using Manchester encoding. FIG. 1 shows an example of a Manchester-encoded digital message 10. With Manchester encoding, the bits of the digital message 10, i.e., either a logic low (or zero) value or a logic high (or one) value, are encoded in the transitions (i.e., the edges) of the message on the communication link. When no messages are being transmitted on the communication link, the link floats high in an idle state. To transmit a logic low (i.e., zero) value, each DALI ballast is operable to "short" the communication link (i.e., electrically connect the two conductors of the link) to cause the communication link to change from the idle state (i.e., approximately 18 $V_{DC}$) to a shorted state (i.e., a "high-to-low" transition) as shown at time $t_0$ in FIG. 1. Conversely, to transmit a logic high (i.e., one) value, each DALI ballast is operable to cause the communication link to transition from the shorted state to the idle state (i.e., a "low-to-high" transition) as shown at time $t_1$ in FIG. 1. After the final bit, the digital message 10 comprises two stop bits S during which the link is high (i.e., idle) for the length of two full bit times $T_{FB}$ to indicate that the digital message is over.

The transitions of the digital message 10 occur near the middle of consecutive bit windows, which each extend for a full bit time $T_{FB}$ (e.g., approximately 832 μsec) as shown in FIG. 1. Each full bit time $T_{FB}$ consists of two half-bit times $T_{HB}$ between the beginning of the full bit time $T_{FB}$ and the transition, and between the transition and the end of the full bit time $T_{FB}$.

The DALI protocol is standardized in accordance with technical standards published by the International Electrotechnical Commission (IEC), which define many required operating characteristics of DALI ballasts. Specifically, the first revision of the technical standard defining the DALI protocol is IEC standard 60929, while the second revision is IEC standard 62386. The technical standard imposes limitations on the length of the full-bit times $T_{FB}$ and the half-bit times $T_{HB}$ of transmitted digital messages. For example, the full-bit times $T_{FB}$ must be between 750 μsec and 916 μsec, while the half-bit times $T_{HB}$ must be between 375 μsec and 458 μsec (according to the first revision, i.e., IEC standard 60929). In addition, the IEC standard also defines a maximum value of a delay time $T_{DELAY}$ (or "settling time") that exists between two consecutively transmitted digital message. For example, the delay time $T_{DELAY}$ may be limited to a maximum of approximately 60 msec. According to the second revision (i.e., IEC standard 62386), the full-bit times $T_{FB}$ must be between 750 μsec and 916 μsec, and the half-bit times $T_{HB}$ must be between 334 μsec and 500 μsec.

However, DALI ballasts sold by some manufacturers may not actually operate within the specifications of the DALI standard. If DALI controllers and DALI ballasts from different manufactures are installed on a single DALI communication link and some of the DALI ballasts do not perform within the specifications of the DALI standard, the entire lighting control system may not function correctly as a result. Thus, there is a need for a method of determining if a DALI ballast does not comply to the specifications of the DALI standard.

SUMMARY OF THE INVENTION

According to an embodiment of the present invention, a control device comprises a communication circuit adapted to be coupled to an electronic ballast via a communication link, and a controller coupled to the communication circuit for transmitting and receiving digital messages via the communication link according to a predefined protocol standard. The controller is operable to determine whether the ballast is operating within predefined limits of the protocol standard, and to adapt how the communication circuit transmits or receives digital messages in response to determining that the ballast is not operating within the predefined limits set by the protocol standard. According to another embodiment of the present invention, the controller may be operable to provide feedback if the ballast is not operating within the limits of the protocol standard In addition, a load control system for controlling the amount of power delivered to one or more electrical loads is also described herein. The load control system comprises a first control device adapted to be coupled to a communication link, and a second control device adapted to be coupled to the communication link and operable to transmit and receive digital messages via the communication link according to a predefined protocol standard. The second control device is operable to determine whether the first control device is operating within predefined limits of the protocol standard, and to adapt how the digital messages are transmitted or received in response to determining that the first control device is not operating within the predefined limits set by the protocol standard. According to another embodiment of the present invention, the second control device may be operable to provide feedback in response to determining that the first control device is not operating within the predefined limits set by the protocol standard.

The present invention also provides a method of confirming that a control device operable to transmit and receive digital messages on a communication link complies with a predefined protocol standard. The method comprises the steps of: (1) determining whether the control device is operating within predefined limits of the protocol standard; and (2) adapting how digital messages are transmitted to or are received from the control device in response to determining that the control device is not operating within the predefined limits set by the protocol standard. According to another embodiment of the present invention, the method may comprise the step of providing feedback in response to determining that the control device is not operating within the predefined limits set by the protocol standard.

Other features and advantages of the present invention will become apparent from the following description of the invention that refers to the accompanying drawings.

DETAILED DESCRIPTION OF THE INVENTION

Figure 1:
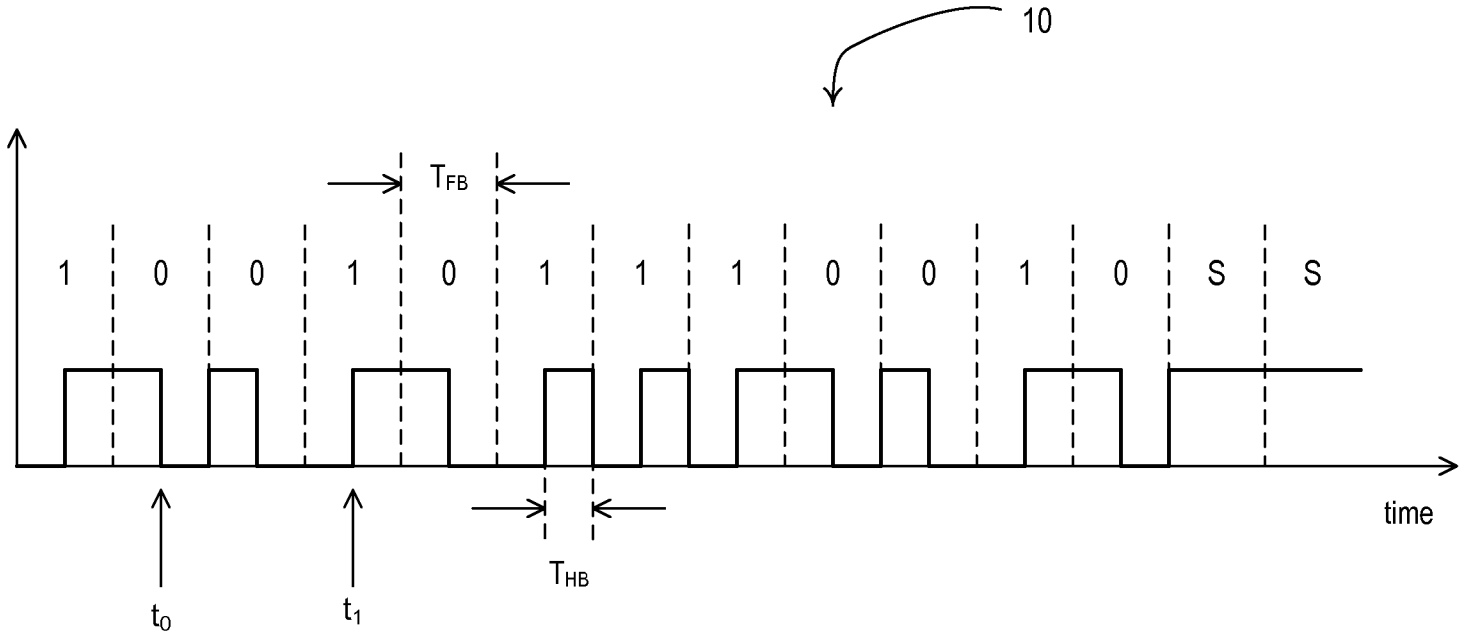
FIG. 1 shows an example of a Manchester-encoded digital message.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2:
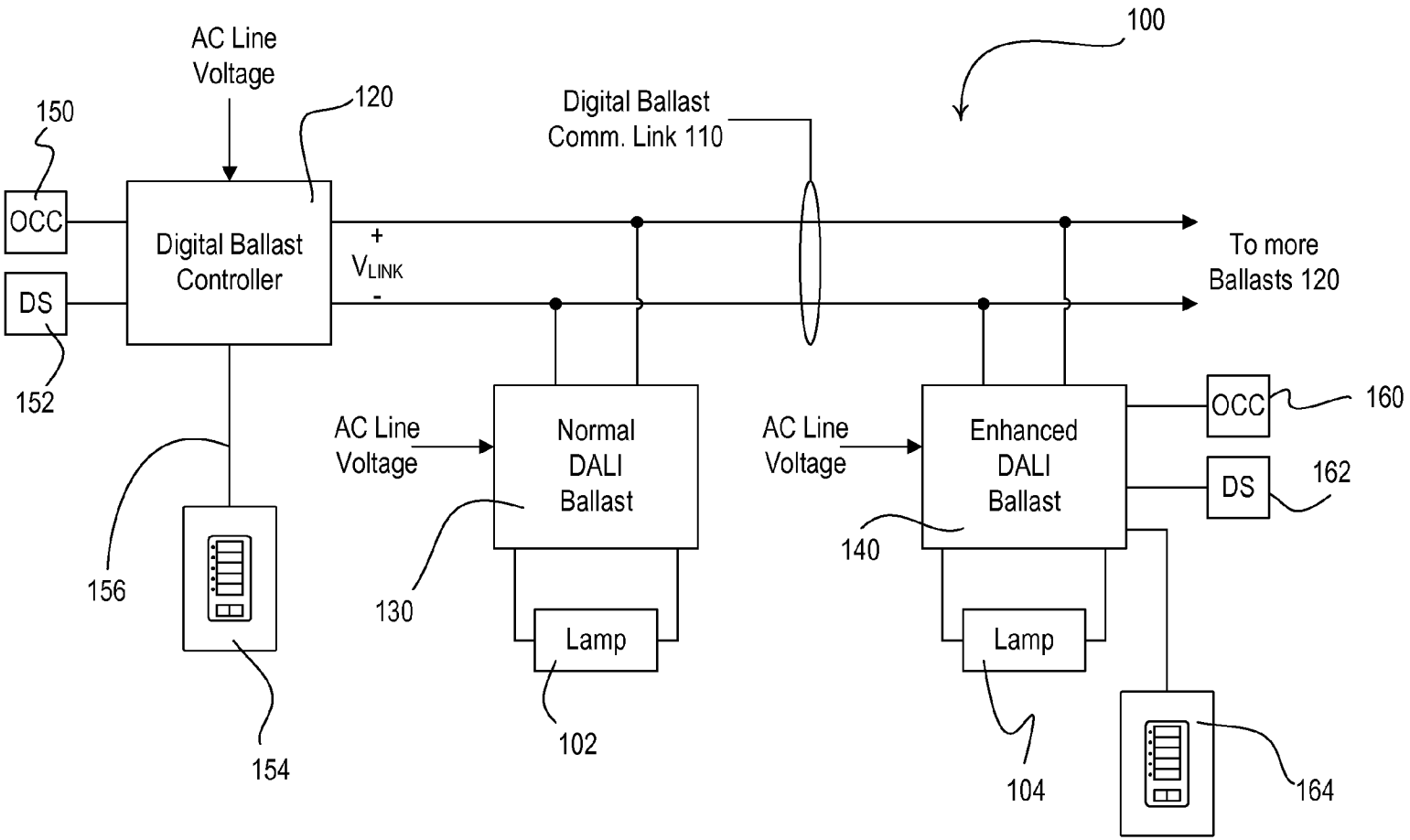
FIG. 2 is a simplified block diagram of a lighting control system for control of the intensity of a plurality of fluorescent lamps according to an embodiment of the present invention.

FIG. 2 is a simplified block diagram of a load control system, e.g., a fluorescent lighting control system 100 for control of the intensity of a plurality of fluorescent lamps 102, 104, according to an embodiment of the present invention. The fluorescent lighting control system 100 includes a digital ballast communication link 110 (e.g., a DALI communication link). The digital communication link 110 is coupled to a digital ballast controller (DBC) 120 and two digital electronic dimming ballasts (e.g., a first normal DALI ballast 130 and a second enhanced DALI ballast 140), which are operable to transmit and receive digital messages according to a predefined protocol standard (e.g., the DALI standard). The digital ballast controller 120 operates as a link power supply for the digital communication link 110. Specifically, the digital ballast controller 120 receives line voltage and generates a DC link voltage $V_{LINK}$ (e.g., approximately 18 $V_{DC}$) for the digital ballast communication link 110. The digital ballast controller 120 is operable to receive inputs from, for example, an occupancy sensor (OCC) 150 and a daylight sensor (DS) 152. The digital ballast controller 120 is also coupled to a keypad 154 via a keypad communication link 156.

The digital ballast controller 120 is operable to transmit digital messages to the ballasts 130, 140 in response to the inputs provided by the occupancy sensor 150, the daylight sensor 152, and the keypad 154. Specifically, the digital ballast controller 120 is operable to transmit command messages, configuration messages, and query messages to the ballasts 130, 140. The ballasts 130, 140 are operable to control the respective lamps 102, 104 in response to receiving one or more consecutive command messages. The command messages may include instructions for the ballasts 130, 140 to control the respective lamps 102, 104 to specific lighting intensities. The ballasts 130, 140 are operable to store a new value for a setting of the ballast in a memory 376 (FIG. 4) in response to receiving two consecutive (and identical) configuration messages. The ballast setting may comprise, for example, a high-end trim, a low-end trim, a fade time, a ballast group, or an intensity value for a specific lighting preset. The query messages simply comprise requests for information regarding the preset ballast settings of the ballasts 130, 140.

The ballasts 130, 140 are each coupled to an alternating-current (AC) mains line voltage and control the amount of power delivered to the lamps 102, 104 to thus control the intensities of the lamps. The normal DALI ballast 130 is simply able to receive and respond to command, configuration, and query messages transmitted on the digital communication link 110 by the digital ballast controller 120 and the enhanced DALI ballast 140. The normal DALI ballast 130 is only able to transmit responses to command, configuration, and query messages. In contrast, the enhanced DALI ballast 140 is operable to transmit command messages on the digital communication link 110. The enhanced DALI ballast 140 is also operable to receive a plurality of inputs from, for example, an occupancy sensor 160, a daylight sensor 162, and a keypad 164. The enhanced DALI ballast 140 is operable to transmit digital messages (i.e., command messages) on the digital communication link 110 and to control the intensities of the lamps 102, 104 in response to the inputs received from the occupancy sensor 160, the daylight sensor 162, and the keypad 164. The digital ballast controller 120 may be coupled to more ballasts 130, 140, for example, up to 64 ballasts.

The digital ballast controller 120 and the ballasts 130, 140 use Manchester encoding to transmit and receive digital messages on the communication link 110 (as shown by the digital message 10 in FIG. 1). To transmit a logic low value (i.e., zero), the digital ballast controller 120 and the ballasts 130, 140 short (i.e., electrically connect) the conductors of the communication link 110 to cause the communication link to transition from the idle state to the shorted state (i.e., an active state). To transmit a logic high value (i.e., one), the digital ballast controller 120 and the ballasts 130, 140 cause the communication link 110 to transition from the shorted state to the idle state. Therefore, the digital ballast controller 120 and the ballasts 130, 140 are operable to transmit digital messages by alternating the digital ballast communication link 110 between the shorted state and the idle state.

Figure 3:
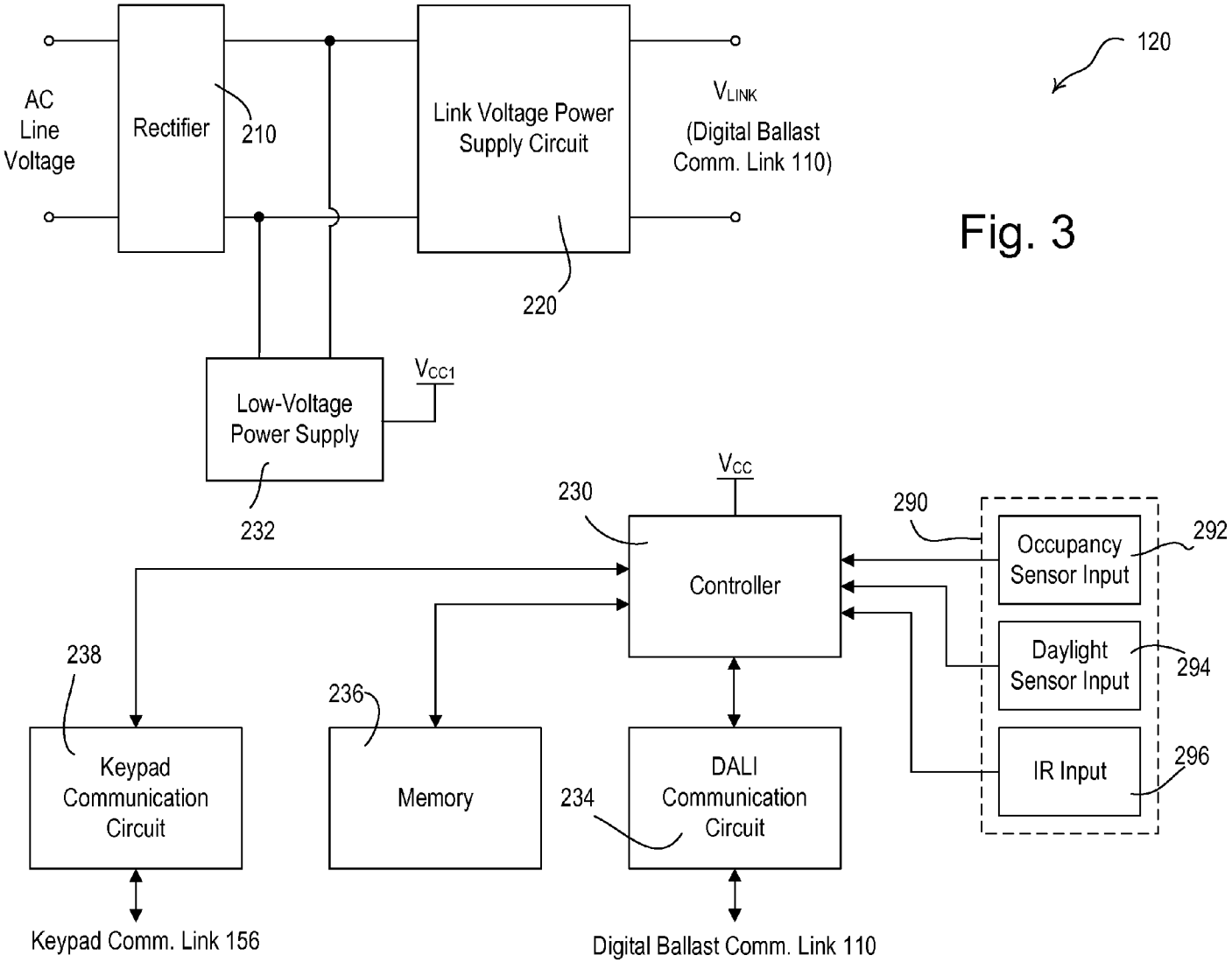
FIG. 3 is a simplified block diagram of a digital ballast controller of the lighting control system of FIG. 2.

FIG. 3 is a simplified block diagram of the digital ballast controller 120 of the fluorescent lighting control system 100. The digital ballast controller 120 comprises a rectifier 210 for receiving the AC line voltage and for generating a rectified voltage. A link voltage power supply circuit 220 receives the rectified voltage and generates the DC link voltage $V_{LINK}$ (i.e., approximately 18 $V_{DC}$) for the digital ballast communication link 110. A controller 230 is coupled to a memory 236 and a communication circuit 234 for transmitting and receiving digital messages on the digital ballast communication link 110. The controller 230 comprises, for example, a microcontroller, but may comprise any suitable type of controller, such as, a programmable logic device (PLD), a microprocessor, or an application specific integrated circuit (ASIC). A power supply 232 is connected across the outputs of the rectifier 210 to provide a DC supply voltage $V_{CC1}$ (e.g., 5 V), which is used to power the controller 230 and other low-voltage circuitry of the digital ballast controller 120. The controller 230 is also coupled to a keypad communication circuit 238 for transmitting and receiving digital messages with the keypad 154 via the keypad communication link 156. The digital ballast controller 120 further comprises a plurality of inputs 290 having an occupancy sensor input 292, a daylight sensor input 294, and an infrared (IR) input 296. The controller 230 is coupled to the plurality of inputs 290 such that the controller is responsive to the occupancy sensor 150, the daylight sensor 152, and an IR receiver (not shown) of the DALI lighting control system 100.

Figure 4:
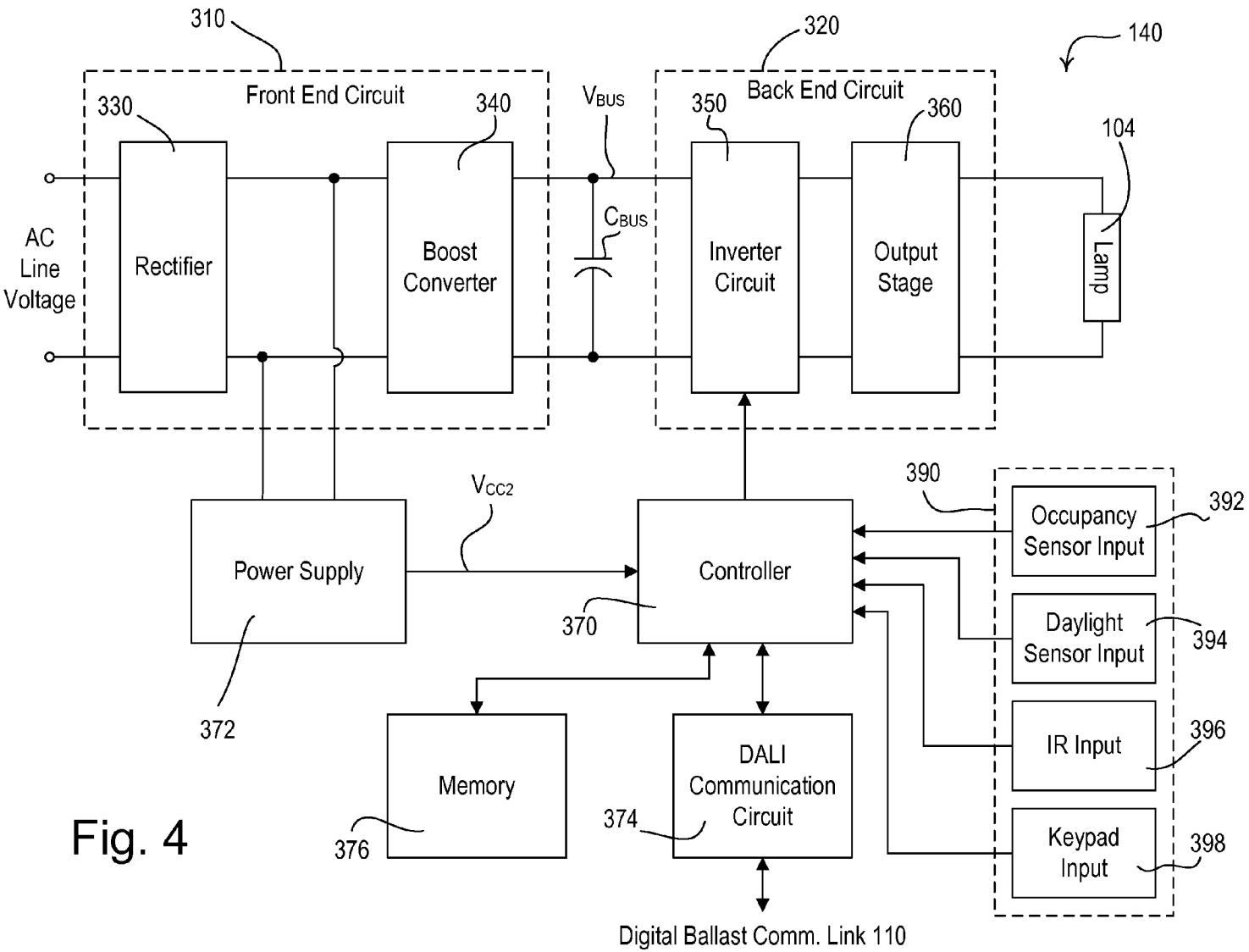
FIG. 4 is a simplified block diagram of a digital electronic dimming ballast of the lighting control system of FIG. 2.

FIG. 4 is a simplified block diagram of the enhanced DALI ballast 140 of the fluorescent lighting control system 100. The enhanced DALI ballast 140 comprises a front end circuit 310 and a back end circuit 320. The front end circuit 310 includes a rectifier 330 for producing a rectified voltage from the AC mains line voltage, and a boost converter 340 for generating a direct-current (DC) bus voltage $V_{BUS}$ across a bus capacitor $C_{BUS}$. The front end circuit 310 may alternatively comprise a valley-fill circuit or a voltage doubler circuit (rather than the boost converter 340) for generating the DC bus voltage $V_{BUS}$. The back end circuit 320 includes an inverter circuit 350 for converting the DC bus voltage $V_{BUS}$ to a high-frequency AC voltage and an output circuit 360 (comprising a resonant tank circuit) for coupling the high-frequency AC voltage to the lamp electrodes. Examples of front end and back end circuits of for electronic dimming ballasts are described in greater detail in commonly-assigned U.S. Pat. No. 6,674,248, issued Jan. 6, 2004, entitled ELECTRONIC BALLAST, and U.S. Pat. No. 7,528,554, issued May 5, 2009, entitled ELECTRONIC BALLAST HAVING A BOOST CONVERTER WITH AN IMPROVED RANGE OF OUTPUT POWER. The entire disclosures of both patents are hereby incorporated by reference.

A controller 370 generates drive signals to control the operation of the inverter circuit 350 so as to provide a desired load current to the lamp 104. The controller 370 comprises, for example, a microprocessor, but may comprise any suitable type of controller, such as, a programmable logic device (PLD), a microcontroller, or an application specific integrated circuit (ASIC). A power supply 372 is connected across the outputs of the rectifier 330 to provide a DC supply voltage $V_{CC2}$, which is used to power the controller 370. A communication circuit 374 is coupled to the controller 370 and allows the controller to communicate with the digital ballast controller 120 and the other ballast 130 on the digital ballast communication link 110. The controller 270 is further coupled to a memory 376 for storing, for example, a serial number, a short address, and the other ballast settings, such as, the high-end trim, the low-end trim, the fade time, the ballast group, and/or the lighting intensities of the various lighting presets.

The enhanced DALI ballast 140 further comprises a plurality of inputs 390 having an occupancy sensor input 392, a daylight sensor input 394, an infrared (IR) input 396, and a keypad input 398, such that the controller 370 is responsive to the occupancy sensor 160, the daylight sensor 162, an IR receiver (not shown), and the keypad 164, respectively. An example of the enhanced DALI ballast 140 is described in greater detail in commonly-assigned U.S. patent application Ser. No. 10/824,248, filed Apr. 14, 2004, entitled MULTIPLE-INPUT ELECTRONIC BALLAST WITH PROCESSOR, and U.S. patent application Ser. No. 11/011,933, filed Dec. 14, 2004, entitled DISTRIBUTED INTELLIGENCE BALLAST SYSTEM AND EXTENDED LIGHTING CONTROL PROTOCOL. The entire disclosures of both applications are hereby incorporated by reference.

The digital ballast controller 120 is operable to determine whether the normal DALI ballast 130 is operating within predefined specifications (i.e., limits) of the DALI standard. Specifically, the digital ballast controller 120 is operable to measure the bit times of a digital message received from the normal DALI ballast 130 and to determine if the bit times fall within the limits set by the DALI standard. The digital ballast controller 120 is further operable to determine a minimum delay time $T_{DELAY\text{-}MIN}$ required between two digital messages received by the normal DALI ballast 130 and to determine if the minimum delay time $T_{DELAY\text{-}MIN}$ falls within the limit set by the DALI standard. In addition, the digital ballast controller 120 is operable to adapt its normal operation (e.g., how digital messages are received and transmitted) in response to determining that the normal DALI ballast 130 is operating outside of the limits of the DALI standard. The digital ballast controller 120 may also provide feedback to a user of the fluorescent lighting control system 100 in response to determining that the normal DALI ballast 130 is operating outside of the limits of the DALI standard.

Figure 5:
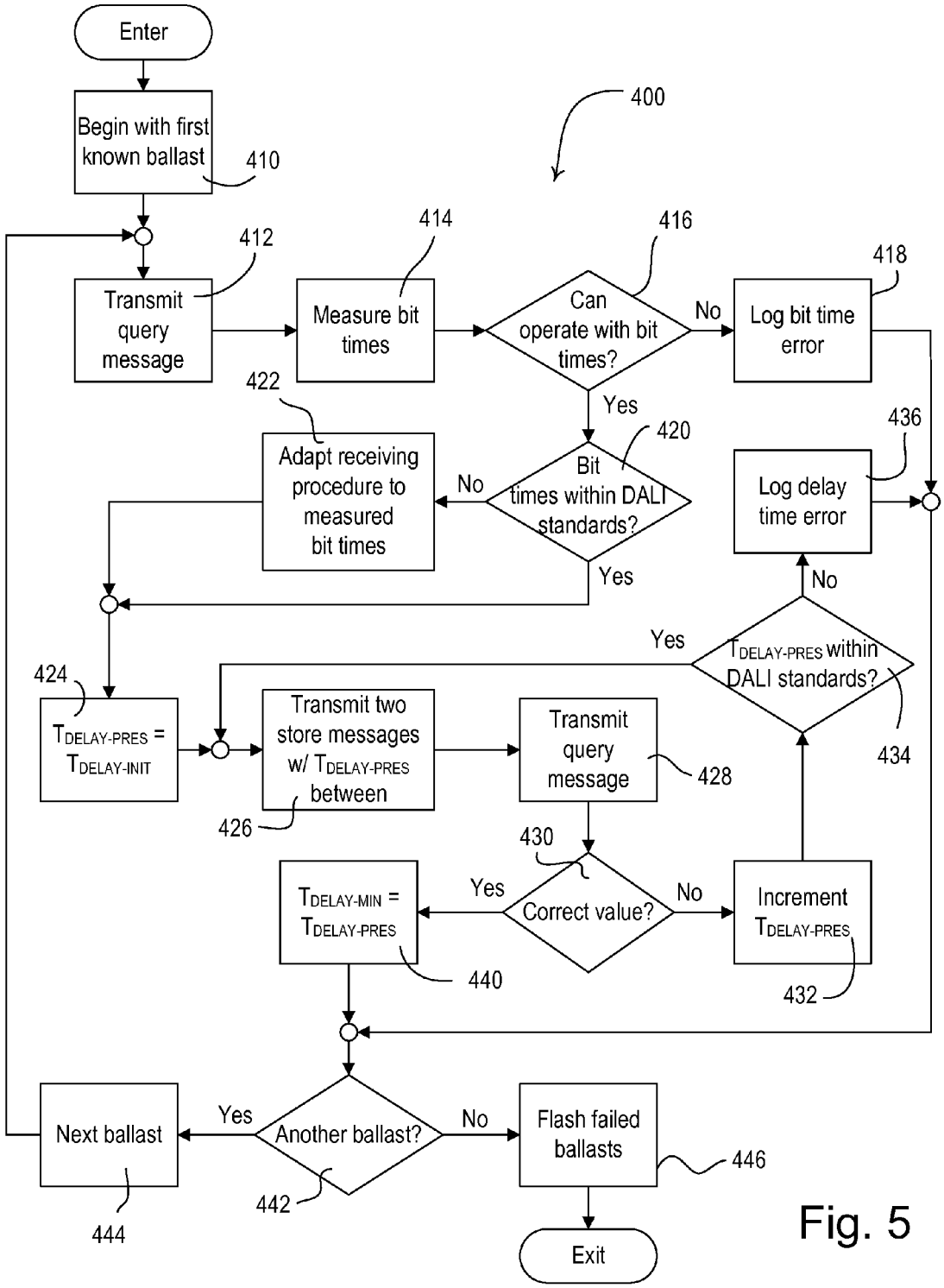
FIG. 5 is a simplified flowchart of a compliance confirmation procedure executed by the digital ballast controller of FIG. 2 according to the embodiment of the present invention.

FIG. 5 is a simplified flowchart of a compliance confirmation procedure 400 executed by the digital ballast controller 120 in response to a user input, for example, an actuation of one of the buttons of the keypad 158. The digital ballast controller 120 tests (i.e., measures) the bit times of digital messages received from each of the normal DALI ballasts 130 and determines the amount of delay required between two digital messages transmitted to each of the normal DALI ballasts 130 (i.e., the minimum delay time $T_{DELAY\text{-}MIN}$). Referring to FIG. 5, the digital ballast controller 120 begins with the first known ballast at step 410 and then tests the bit times. Specifically, the digital ballast controller 120 transmits a query message (which may include a request to transmit a value of a setting of the ballast, such as, a lighting intensity value for a specific lighting preset) to the first ballast at step 412. At step 414, the digital ballast controller 120 measures all of the half-bit times $T_{HB}$ of the response to the query message transmitted at step 412. If the digital ballast controller 120 cannot operate with the measured half-bit times $T_{HB}$ at step 416 (i.e., the measured bit times are outside of maximum operational limits), the digital ballast controller will not be able to communicate with the ballast during normal operation, Thus, the digital ballast controller logs a bit time error (i.e., stores a representation of the error) in the memory 376 at step 418.

If the digital ballast controller 120 is able to operate with the measured half-bit times $T_{HB}$ at step 416, the digital ballast controller 120 compares the measured bit times to the limits set by the DALI standard at step 420. If the bit times do not fall within the limits set by the DALI standard at step 420 (e.g., are not between 374 μsec and 458 μsec), the digital ballast controller 120 adapts the receiving procedure (e.g., adjusts the timing thresholds used when receiving a digital message) according to the measured bit times at step 422, such that the digital ballast controller 120 will be able to reliably receive digital messages from the ballast during normal operation. If the bit times fall within the limits set by the DALI standard at step 420, the digital ballast controller 120 does not adapt the receiving procedure and simply moves on to test the delay times.

To test the delay times, the digital ballast controller 120 first sets a present delay time $T_{DELAY\text{-}PRES}$ to an initial delay time $T_{DELAY\text{-}INIT}$ (e.g., 9 msec) at step 424. The digital ballast controller 120 then transmits two consecutive (and identical) configuration messages to the ballast with the present delay time $T_{DELAY\text{-}PRES}$ between the two messages at step 426. For example, the configuration message may cause the ballast to store a new intensity value for a specific lighting preset. Since the ballast must receive two consecutive (and identical) configuration messages in order to store a new value for a setting, the controller 120 is operable to determine if the ballast did not receive the second of the two consecutive configuration messages, if the ballast did not store the new value of the setting in memory. If the ballast requires a greater amount of delay between two consecutive digital messages (i.e., greater than the present delay time $T_{DELAY\text{-}PRES}$), the ballast will not be able to receive both of the consecutive digital messages transmitted at step 426 and thus will not store the new value of the ballast setting. At step 428, the digital ballast controller 120 transmits to the ballast a query message for the stored value of the ballast setting (i.e., the intensity value of the specific preset from the configuration messages of step 426). If the response does not include the appropriate new value of the ballast setting at step 430 (i.e., the ballast did not receive the two messages transmitted at step 426), the digital ballast controller 120 increases the present delay time $T_{DELAY\text{-}PRES}$ (e.g., increments the present delay time by one msec) at step 432 and compares present the delay time $T_{DELAY\text{-}PRES}$ to the limits set by the DALI standard at step 434.

If the new present delay time $T_{DELAY\text{-}PRES}$ does not fall within the limits of the DALI standard at step 434 (e.g., 60 msec), the digital ballast controller logs a delay time error at step 436. If the new present delay time $T_{DELAY\text{-}PRES}$ falls within the limits of the DALI standard at step 434, the digital ballast controller tests the ballast with the increased present delay time $T_{DELAY\text{-}PRES}$ by transmitting two consecutive configuration messages with the increased present delay time $T_{DELAY\text{-}PRES}$ between the messages at step 426 and transmitting another query message to the ballast at step 428. If the response includes the correct new value of the ballast setting at step 430 (i.e., the ballast received the two messages transmitted at step 426), the digital ballast controller 120 has determined that the minimum delay time $T_{DELAY\text{-}MIN}$ required by the ballast is equal to the present delay time $T_{DELAY\text{-}PRES}$. Accordingly, the digital ballast controller 120 adapts the transmitting procedure to use the determined minimum delay time $T_{DELAY\text{-}MIN}$ required by the ballast at step 440 (i.e., the digital ballast controller 120 will transmit digital messages with at least the minimum delay time $T_{DELAY\text{-}MIN}$ between consecutive messages).

Alternatively, the digital ballast controller 120 could transmit two consecutive command messages to the ballast and determine if the ballast received the second command message to determine the minimum delay time $T_{DELAY\text{-}MIN}$ required between two consecutive digital message received by the ballast. For example, the digital ballast controller 120 could transmit a first command message including an instruction to control the lighting intensity of the connected lamp to a first intensity (e.g., 50%) and then transmit a second command message including an instruction to control the lighting intensity of the connected lamp to a second intensity (e.g., 75%) with the present delay time $T_{DELAY\text{-}PRES}$ between the first and second command messages. The digital ballast controller 120 could then transmit a query message to the ballast to determine the present lighting intensity of the connected lamp. If present lighting intensity of the connected lamp is equal to the second intensity of the second command message, the digital ballast controller 120 can determine that the ballast did not receive the second command message and that the present delay time $T_{DELAY\text{-}PRES}$ between consecutive messages must be increased.

Referring back to FIG. 4, after the digital ballast controller 120 has finished testing to determine the required minimum delay time $T_{DELAY\text{-}MIN}$ of the present ballast (at steps 424-440) or after the digital ballast controller 120 logs a bit time error at step 418 or a log delay time error at step 436, a determination is made at step 442 as to whether there are any more normal DALI ballasts 130 to test. If so, digital ballast controller 120 moves onto the next ballast at step 444 and tests the bit times for that ballast at steps 412-422. If there are no more ballasts to test at step 442, the digital ballast controller 120 provides feedback as to the result of the tests at step 446, for example, by flashing the lamps of those ballasts that had bit time errors logged at step 418 or delay time errors logged at step 436 (i.e., those ballast with which the digital ballast controller cannot communication during normal operation). Finally, the compliance confirmation procedure 400 exits.

Alternatively, the digital ballast controller 120 could illuminate or flash the lamps of those ballasts that passed both the bit time test and the delay time test at step 446. In addition, the digital ballast controller 120 could provide other forms of feedback. For example, the digital ballast controller 120 could be in communication with a personal computer (or other type of processor), such that the digital ballast controller could cause the personal computer to send an email or print a report in response to the results of the bit time test and the delay time test. The digital ballast controller 120 may also be operable to provide feedback for those ballasts that are not operating within the specifications of the DALI standard.

While the compliance confirmation procedure 400 was described herein as executed by the digital ballast controller 120 to test the operation of the normal DALI ballasts 130, the compliance confirmation procedure could also be executed by the enhanced DALI ballast 140 or another control device connected to the digital ballast communication link 110. In addition, the compliance confirmation procedure 400 could be executed to determine if the enhanced DALI ballast 140 is operating within the specifications of the DALI standard.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A control device comprising:

a communication circuit adapted to be coupled to an electronic ballast via a communication link; and a controller coupled to the communication circuit for transmitting and receiving digital messages via the communication link according to a predefined protocol standard;

wherein the controller is operable to determine a minimum delay time required between two digital messages received by the ballast, the controller operable to determine whether the ballast is operating within predefined limits of the protocol standard by transmitting two consecutive digital messages to the ballast with a present delay time between the two digital messages;

determining that the present delay time between the two digital messages is too short for the ballast if the ballast did not receive the second one of the two consecutive digital messages; and comparing the present delay time to the predefined limits set by the protocol standard;

wherein the controller is further operable to adapt how the communication circuit transmits or receives digital messages by setting the minimum delay time equal to the present delay time if the ballast received the second one of the two consecutive digital messages.

2. The control device of claim 1, wherein the controller increases the present delay time provided between the two digital messages if the ballast did not receive the second one of the two consecutive digital messages.

3. The control device of claim 2, wherein the controller is operable to adapt how the communication circuit transmits digital messages by transmitting digital messages to the ballast with the minimum delay time used between any two consecutive digital messages.

4. The control device of claim 2, wherein the controller is operable to transmit two consecutive and identical configuration messages to the ballast with the present delay time between the two configuration messages, the configuration messages instructing the ballast to store a new value of a setting, the controller operable to determine that the present delay time between the two configuration messages is too short for the ballast if the ballast did not store the new value of the setting.

5. The control device of claim 2, wherein the controller is operable to transmit first and second consecutive command messages to the ballast with the present delay time between the two command messages, the first command message including an instruction for the ballast to control the intensity of a connected lamp to a first lighting intensity, the second command message including an instruction for the ballast to control the intensity of the connected lamp to a second lighting intensity, the controller operable to determine that the present delay time between the two configuration messages is too short for the ballast if the ballast did not control the intensity of the connected lamp to the second lighting intensity.

6. The control device of claim 1, wherein the communication circuit is operable to receive a first digital message from the ballast and the controller is operable to determine if a characteristic of the first digital message is within the predefined limits set by the protocol standard.

7. The control device of claim 6, wherein the controller is operable to measure bit times of the first digital message received from the ballast and to determine if the bit times fall within the predefined limits set by the protocol standard.

8. The control device of claim 7, wherein the controller uses timing thresholds when receiving digital messages, the controller operable to adapt how the communication circuit receives digital messages by adjusting the timing thresholds if the bit times of the first digital message fall outside the predefined limits set by the protocol standard.

9. The control device of claim 1, wherein the controller is operable to provide feedback if the ballast is not operating within the limits set by the protocol standard.

10. The control device of claim 9, wherein the controller provides feedback by causing the ballast to flash a connected lamp, causing an email to be sent, or causing a report to be printed.

11. A load control system for controlling the amount of power delivered to one or more electrical loads, the load control system comprising:

a first control device adapted to be coupled to a communication link; and a second control device adapted to be coupled to the communication link and operable to transmit and receive digital messages via the communication link according to a predefined protocol standard, the second control device operable to determine a minimum delay time required between two digital messages received by the first control device, the second control device further operable to determine whether the first control device is operating within predefined limits of the protocol standard by transmitting two consecutive digital messages to the first control device with a present delay time between the two digital messages, determining that the present delay time between the two digital messages is too short for the first control device if the first control device did not receive the second one of the two consecutive digital messages, and comparing the present delay time to the predefined limits set by the protocol standard;

wherein the second control device is further operable to adapt how the digital messages are transmitted or received by setting the minimum delay time required between two digital messages received by the first control device equal to the present delay time if the first control device received the second one of the two consecutive digital messages.

12. The load control system of claim 11, wherein the second control device increases the present delay time provided between the two digital messages if the first control device did not receive the second one of the two consecutive digital messages.

13. The load control system of claim 12, wherein the second control device is operable to adapt how digital messages are transmitted by using the minimum delay time between any two consecutive digital messages transmitted to the first control device.

14. The load control system of claim 12, wherein the first control device is operable to store a new value for a setting in response to receiving two consecutive and identical configuration messages from the second control device, the second control device operable to transmit two consecutive and identical configuration messages to the first control device with the present delay time between the two configuration messages, the second control device operable to determine that the present delay time between the two configuration messages is too short for the first control device if the first control device did not store the new value of the setting.

15. The load control system of claim 12, wherein the first control device comprises an electronic ballast for controlling the intensity of a fluorescent lamp, the electronic ballast operable to control the intensity of the lamp in response to receiving a command message from the second control device, the second control device operable to transmit first and second consecutive command messages to the ballast with the present delay time between the two command messages, the first command message including an instruction for the ballast to control the intensity of the lamp to a first lighting intensity, the second command message including an instruction for the ballast to control the intensity of the lamp to a second lighting intensity, the second control device operable to determine that the present delay time between the two configuration messages is too short for the ballast if the ballast did not control the intensity of the connected lamp to the second lighting intensity.

16. The load control system of claim 11, wherein the first control device comprises an electronic ballast for controlling the intensity of a fluorescent lamp.

17. The load control system of claim 16, wherein the predefined protocol standard comprises the DALI standard and the communication link comprises a DALI communication link.

18. The load control system of claim 17, wherein the second control device comprises a link power supply.

19. The load control system of claim 17, wherein the second control device comprises an electronic ballast.

20. The load control system of claim 11, wherein the second control device is operable to receive a first digital message from the first control device and to determine if a characteristic of the first digital message is within the predefined limits set by the protocol standard.

21. The load control system of claim 20, wherein the second control device is operable to measure bit times of the first digital message received from the ballast and to determine if the bit times fall within the predefined limits set by the protocol standard.

22. The load control system of claim 21, wherein the second control device uses timing thresholds when receiving digital messages, the second control device operable to adapt how digital messages are received by adjusting the timing thresholds if the bit times of the first digital message fall outside the predefined limits set by the protocol standard.

23. The load control system of claim 11, wherein the second control device provides feedback in response to determining the first control device is not operating within the limits set by the protocol standard.

24. A method of confirming that a control device operable to transmit and receive digital messages on a communication link complies with a predefined protocol standard, the method comprising the steps of:

determining whether the control device is operating within predefined limits of the protocol standard by transmitting two consecutive digital messages to the control device with a present delay time between the two digital messages, determining that the present delay time between the two digital messages is too short for the control device if the control device did not receive the second one of the two consecutive digital message, and comparing the present delay time to the limits set by the protocol standard; and adapting how digital messages are transmitted to or are received from the control device by setting a minimum delay time required between two digital messages received by the control device equal to the present delay time if the control device received the second one of the two consecutive digital messages.

25. The method of claim 24, wherein the step of determining whether the control device is operating within predefined limits further comprises the steps of:

increasing the present delay time provided between the two digital messages if the control device did not receive the second one of the two consecutive digital messages.

26. The method of claim 25, wherein the step of adapting how digital messages are transmitted to or are received from the control device further comprises the step of:

transmitting digital messages to the control device with the minimum delay time used between any two consecutive digital messages.

27. The method of claim 25, wherein the step of determining whether the control device is operating within predefined limits further comprises the steps of:

transmitting two consecutive and identical configuration messages to the control device with the present delay time between the two configuration messages, the configuration messages instructing the control device to store a new value of a setting; and determining that the present delay time between the two configuration messages is too short for the ballast if the ballast did not store the new value of the setting.

28. The method of claim 25, wherein the control device comprises an electronic ballast for controlling the intensity of a fluorescent lamp, and the step of determining whether the control device is operating within predefined limits further comprises the steps of:

transmitting first and second consecutive command messages to the ballast with the present delay time between the two command messages, the first command message including an instruction for the ballast to control the intensity of the lamp to a first lighting intensity, the second command message including an instruction for the ballast to control the intensity of the lamp to a second lighting intensity; and determining that the present delay time between the two configuration messages is too short for the ballast if the ballast did not control the intensity of the connected lamp to the second lighting intensity.

29. The method of claim 24, wherein the step of adapting how digital messages are transmitted to or are received from the control device further comprises the steps of:

receiving a first digital message from the control device; and comparing a characteristic of the first digital message to the predefined limits set by the protocol standard.

30. The method of claim 29, wherein the step of adapting how digital messages are transmitted to or are received from the control device further comprises the steps of:

measuring bit times of the first digital message received from the control device; and comparing the bit times of the first digital message to the predefined limits set by the protocol standard.

31. The method of claim 30, further comprising the step of:

using timing thresholds when receiving digital messages;

wherein the step of adapting how digital messages are transmitted to or are received from the control device further comprises adjusting the timing thresholds if the bit times of the first digital message fall outside the predefined limits set by the protocol standard.

32. The method of claim 24, further comprising the step of:

providing feedback if the control device is not operating within the limits set by the protocol standard.

33. The method of claim 32, wherein the step of providing feedback comprises one of causing a lamp to flash, causing an email to be sent, or causing a report to be printed.

34. A control device comprising:

a communication circuit adapted to be coupled to an electronic ballast via a communication link; and a controller coupled to the communication circuit for transmitting and receiving digital messages via the communication link according to a predefined protocol standard;

wherein the controller is operable to determine whether the ballast is operating within predefined limits of the protocol standard by transmitting two consecutive digital messages to the ballast with a present delay time between the two digital messages;

determining that the present delay time between the two digital messages is too short for the ballast if the ballast did not receive the second one of the two consecutive digital messages; and comparing the present delay time to the predefined limits set by the protocol standard;

wherein the control device is further operable to provide feedback if the ballast is not operating within the limits of the protocol standard.

35. The control device of claim 34, wherein the controller transmits a digital message to the ballast to cause the ballast to flash a connected lamp to provide feedback.

36. The control device of claim 35, wherein the controller causes the ballast to flash the connected lamp to provide feedback if ballast is not operating within the limits of the protocol standard.

37. The control device of claim 35, wherein the controller causes the ballast to flash the connected lamp to provide feedback if ballast is operating within the limits of the protocol standard.

38. The control device of claim 34, wherein the control device causes an email to be sent to provide feedback.

39. The control device of claim 34, wherein the control device causes a report to be printed to provide feedback.

40. The control device of claim 34, wherein the controller is operable to adapt how the communication circuit transmits or receives digital messages in response to determining that the ballast is not operating within the predefined limits set by the protocol standard.

41. A load control system for controlling the amount of power delivered to one or more electrical loads, the load control system comprising:

a first control device adapted to be coupled to a communication link; and a second control device adapted to be coupled to the communication link and operable to transmit and receive digital messages via the communication link according to a predefined protocol standard, the second control device operable determine whether the first control device is operating within predefined limits of the protocol standard by transmitting two consecutive digital messages to the first control device with a present delay time between the two digital messages, determining that the present delay time between the two digital messages is too short for the first control device if the first control device did not receive the second one of the two consecutive digital messages, and comparing the present delay time to the predefined limits set by the protocol standard;

wherein the second control device is further operable to provide feedback in response to determining that the first control device is not operating within the predefined limits set by the protocol standard.

42. The load control system of claim 41, wherein the first control device comprises an electronic ballast for controlling the intensity of a fluorescent lamp.

43. The load control system of claim 42, wherein the predefined protocol standard comprises the DALI standard and the communication link comprises a DALI communication link.

44. The load control system of claim 43, wherein the second control device comprises a link power supply.

45. The load control system of claim 43, wherein the second control device comprises an electronic ballast.

46. The load control system of claim 42, wherein the second control device transmits a digital message to the ballast to cause the ballast to flash a connected lamp to provide feedback if ballast is not operating within the limits of the protocol standard.

47. The load control system of claim 42, wherein the second control device transmits a digital message to the ballast to cause the ballast to flash a connected lamp to provide feedback if ballast is operating within the limits of the protocol standard.

48. The load control system of claim 41, further comprising a personal computer in communication with the second control device, wherein the second control device transmits a digital message to the personal computer to cause the personal computer to send an email to provide the feedback.

49. The load control system of claim 41, further comprising a personal computer in communication with the second control device, wherein the second control device transmits a digital message to the personal computer to cause the personal computer to print a report to provide the feedback.

50. The load control system of claim 41, wherein the second control device is operable to adapt how the digital messages are transmitted or received in response to determining that the first control device is not operating within the predefined limits set by the protocol standard.

51. A method of confirming that a control device operable to transmit and receive digital messages on a communication link complies with a predefined protocol standard, the method comprising the steps of:

determining whether the control device is operating within predefined limits of the protocol standard by transmitting two consecutive digital messages to the control device with a present delay time between the two digital messages, determining that the present delay time between the two digital messages is too short for the control device if the control device did not receive the second one of the two consecutive digital messages, and comparing the present delay time to the limits set by the protocol standard; and providing feedback in response to determining that the control device is not operating within the predefined limits set by the protocol standard.

52. The method of claim 51, wherein the control device comprises an electronic ballast for controlling the intensity of a fluorescent lamp, and the step of providing feedback comprises causing the ballast to flash a connected lamp if control device is not operating within the limits of the protocol standard.

53. The method of claim 51, wherein the control device comprises an electronic ballast for controlling the intensity of a fluorescent lamp, and the step of providing feedback comprises causing the ballast to flash a connected lamp if the ballast is operating within the limits of the protocol standard.

54. The method of claim 51, wherein the step of providing feedback comprises sending an email.

55. The method of claim 51, wherein the step of providing feedback comprises printing a report.

56. The method of claim 51, further comprising the step of:

adapting how digital messages are transmitted to or are received from the control device by setting a minimum delay time required between two digital messages received by the control device equal to the present delay time if the control device received the second one of the two consecutive digital message.

* * * * *